US006418990B1

(12) United States Patent
Lindstrom

(10) Patent No.: US 6,418,990 B1
(45) Date of Patent: Jul. 16, 2002

(54) MATERIAL AND PROCESS FOR ITS PRODUCTION

(75) Inventor: Ove Lindstrom, Skinnskatteberg (SE)

(73) Assignees: Curt Lindhe, Soderbarke; Lennart Castwall, Akersberga, both of (SE)

( * ) Notice: Subject to any disclaimer, the term of this patent is extended or adjusted under 35 U.S.C. 154(b) by 0 days.

(21) Appl. No.: 09/529,488

(22) PCT Filed: Oct. 15, 1998

(86) PCT No.: PCT/SE98/01853

§ 371 (c)(1),
(2), (4) Date: Apr. 14, 2000

(87) PCT Pub. No.: WO99/20443

PCT Pub. Date: Apr. 29, 1999

(30) Foreign Application Priority Data

Oct. 16, 1997 (SE) ..... 9703776

(51) Int. Cl.[7] ..... B27M 1/02

(52) U.S. Cl. ..... 144/348; 144/352; 144/361; 144/380; 156/182; 428/17; 428/317.3

(58) Field of Search ..... 144/348, 349, 144/352, 361, 364, 380, 346; 156/182, 245, 255, 264, 311, 324; 264/130, 131; 428/17, 35.4, 35.6, 317.3, 317.9

(56) References Cited

U.S. PATENT DOCUMENTS

| | | | | | |
|---|---|---|---|---|---|
| 2,567,292 | A | * | 9/1951 | Lundstrom | 144/380 |
| 3,621,897 | A | * | 11/1971 | Vazzola | 144/358 |
| 3,756,345 | A | | 9/1973 | D'Amico et al. | |
| 3,964,863 | A | | 6/1976 | Carr | |
| 4,428,410 | A | * | 1/1984 | Stranberg | 144/361 |
| 4,971,125 | A | * | 11/1990 | Rule | 144/380 |
| 5,190,088 | A | | 3/1993 | Thomassen et al. | |
| 5,240,051 | A | * | 8/1993 | Quick et al. | 144/352 |
| 5,343,913 | A | | 9/1994 | Tanahashi et al. | |
| 5,678,618 | A | * | 10/1997 | Lindhe et al. | 144/380 |
| 5,685,353 | A | * | 11/1997 | Viitaniemi et al. | 144/361 |
| 6,053,224 | A | * | 4/2000 | Hellgren et al. | 144/380 |
| 6,183,812 | B1 | * | 2/2001 | Hellgren | 144/380 |

FOREIGN PATENT DOCUMENTS

| | | | | |
|---|---|---|---|---|
| DE | 516801 | | 1/1931 | |
| DE | 946479 | | 8/1956 | |
| DK | 170364 | | 2/1991 | |
| DK | 169811 | | 5/1994 | |
| SU | 545466 | * | 7/1975 | 144/352 |
| WO | 94/29089 | | 12/1994 | |
| WO | 95/13908 | | 5/1995 | |
| WO | 96/32236 | | 10/1996 | |
| WO | 97/02936 | | 1/1997 | |

* cited by examiner

*Primary Examiner*—W Donald Bray
(74) *Attorney, Agent, or Firm*—Pillsbury Winthrop LLP

(57) ABSTRACT

The invention relates to a process for greatly increasing the elasticity and bendability of diffuse-porous wood and comprises the following steps: a) supplying a specimen of diffuse-porous wood; and b) isostatically pressing the specimen in a) with a pressure of at least 500 bar. The rigidity is increased once again by immersing the wood specimen in a liquid for up to 2 hours, after which the specimen is dried. This can be utilized when producing shaped products made of diffuse-porous wood.

10 Claims, 5 Drawing Sheets

MATERIAL AND PROCESS FOR ITS PRODUCTION

This application is the national phase of international application PCT/SE98/01853 filed Oct. 15, 1998 which designated the U.S.

This invention relates to a process for producing a wood material which possesses controllable bending properties. The process can be used to produce a wood material which possesses a high degree-of elasticity and a high degree of bending ability. The resulting wood material can be readily deformed into a desired shape, after which it is also possible to lock this shape in a simple manner, such that the wood material regains normal bending properties, while the shape has been permanently altered. The invention also relates to a wood material which has been produced using the above mentioned process.

BACKGROUND TO THE INVENTION

Constructions and objects of bent wood have been used by man since time immemorial. Since wood is a rigid material, it has to be softened before being shaped and bent so that it does not split. Traditionally, this softening has been achieved using heat, or, alternatively, using a combination of heat and moisture (for example using steam). Wood has also been softened by impregnating it with chemicals such as ammonia, polyethylene glycol and pyridine.

In modern times, alternative wood materials which possess a high degree of bending and shaping flexibility have also been developed. One type of process is based on thin discs of wood being glued to form a laminated structure whose plasticity is greater than that of the raw wood material. Examples of this are described in JP, A, 9/70804 and JP, A, 7/246605. However, the flexibility of the material described in these documents is not entirely satisfactory, either. Heat is required in connection with the bending step. Finally, the wood material is unable to recover its normal rigidity after the desired deformation has taken place. There is therefore a need for improved processes for temporarily increasing the elasticity of wood materials and for decreasing this elasticity to the normal level once again after the desired bending has taken place.

SUMMARY OF THE INVENTION

It has now been found that it is possible greatly to increase the elasticity and bendability of diffuse-porous wood by means of a process which comprises the following steps:

a) supplying a specimen of diffuse-porous wood; and b) isostatically pressing the specimen in a) with a pressure of at least 500 bar.

The rigidity is increased once again by immersing the wood specimen in a liquid for a period which is sufficiently long for the liquid to be able to penetrate into the whole of the wood specimen and then drying the specimen.

DETAILED DESCRIPTION OF THE INVENTION

Definitions:

The term "isostatic pressing" which is used here relates to pressing with a pressure which is equally great in all directions in space. Pressing wood with a pressure of this nature is described in WO 95/13908. "Diffuse-porous wood" is wood in which the vessels are evenly distributed and are of approximately uniform size over the whole of the annual ring. Examples of trees having diffuse-porous wood are alder, aspen, birch, beech, maple, eucalyptus, Canadian sugar maple, Betula pendula, Acer pseudoplantanus, Acer rubrum, Nyssa sylvatica, Liquidambar styraciflua, Popolus balsamifera, Fagus sylvatica, Banksia prionotes and Banksia ilicifolia.

The term "wood specimen" is used here to signify a specimen of diffuse-porous wood. A "composite wood specimen" refers to a specimen which consists of several smaller diffuse-porous wood specimens which have been glued together parallel to the direction of the fibres in the constituent specimens. In principle, most types of glue which are suitable for wood can be used when producing composite wood specimens. Examples which may be mentioned are cold-water glue, hot-melt glue, solvent-based glue, emulsion-based glue and polymerization-based glue having one or two components. Use can be made, in particular, of glue which contains polyvinyl acetate emulsions, PVC, polystyrene, urea, melamine, melamine-formnaldehyde, phenol and polyurethane. It is simple for a skilled person to select a suitable glue type on the basis of the given conditions.

The term "liquid" is used here to signify a liquid which is able to penetrate into diffuse-porous wood. Examples of such liquids are water and linseed oil/turpentine in a ratio by weight of 1/100–100/1. The liquid can also contain other substances such as dyes and substances which increase resistance to rotting and fire.

The invention will now be described in more detail with reference to the attached figures in which:

FIGS. 1*a*–1*e* shows how the elasticity is altered by the process according to claim 1;

Figure 3A:
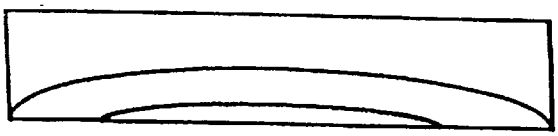
Figure 3B:
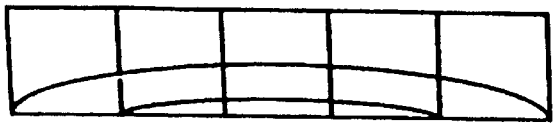
Figure 3C:
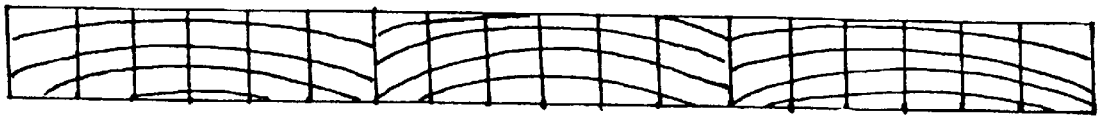
Figure 3D:
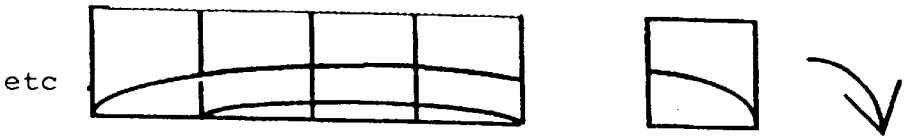
Figure 3E:
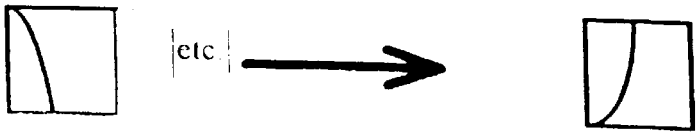
Figure 3F:
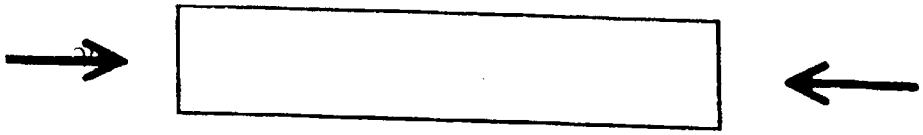
Figure 3G:
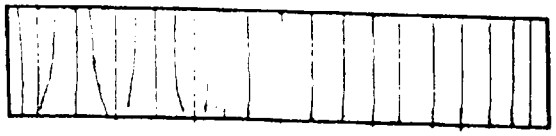
Figure 4:
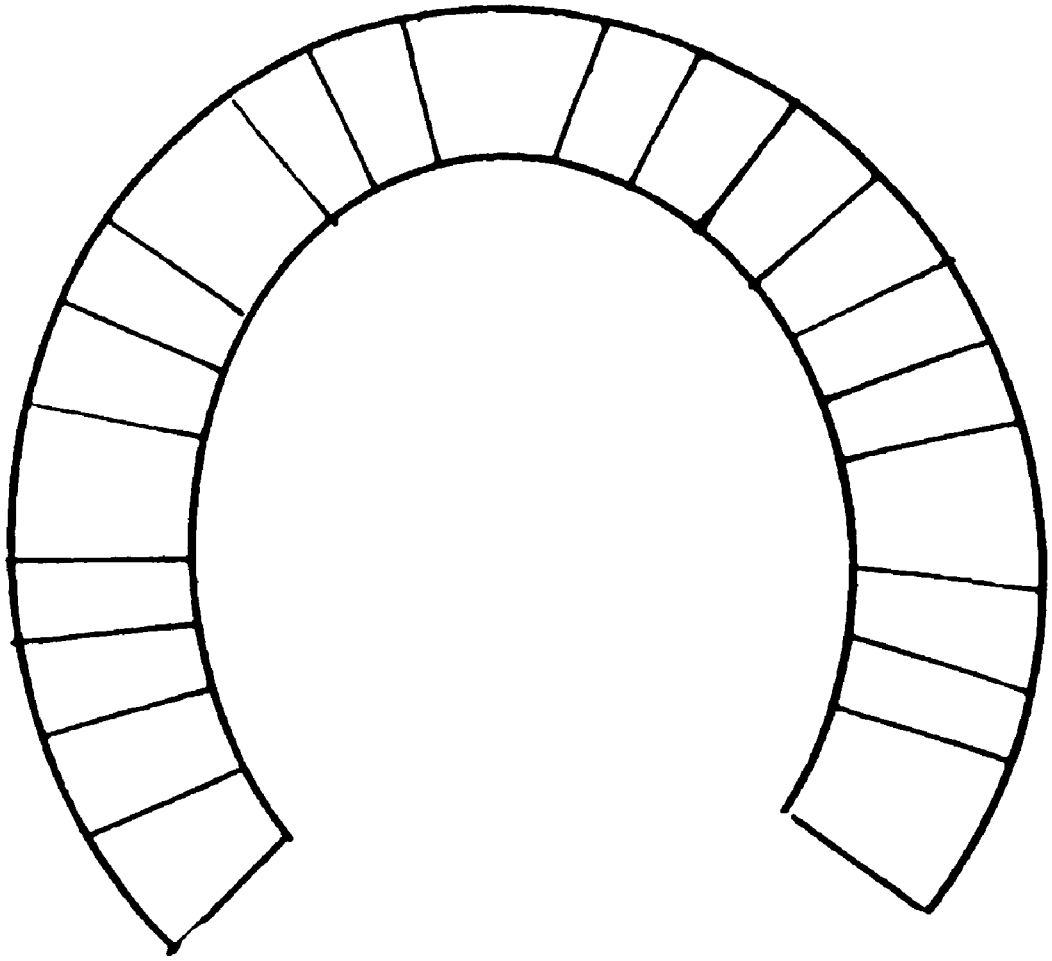

FIG. 3*a*–3*g* shows how composite wood specimens having a high degree of elasticity can be produced by isostatically pressed diffuse-porous wood being sawn and glued in a specific pattern. The annual rings are fully indicated in this figure; and FIG. 4 shows the result of a bending experiment using a composite wood specimen which was produced from diffuse-porous wood specimens whose elastcity had been increased by means of the process according to the invention.

DETAILED DESCRIPTION OF THE INVENTION

As has already been mentioned above, this invention is based on the unexpected discovery that the elasticity of a specimen of diffuse-porous wood is greatly increased after the wood has been isostatically pressed with a pressure of at least 500 bar. Without tying the invention to any particular theory, it is assumed that the increase in the elasticity after the isostatic pressing is due to the vessels or pores, which are quite large and uniformly distributed in diffuse-porous wood, collapsing in an ordered structure. The strength of the fibres appears to be unchanged, as the force required to break the fibres is the same as for ordinary wood material. The increased elasticity does not therefore occur in all directions.

FIG. 1 .shows how the elasticity is altered in the diffuse-porous wood after isostatic pressing in accordance with the invention. FIG. 1A shows a specimen of diffuse-porous wood mi which the fibres are oriented from the surface ABCD to the surface EFGH. The annual rings are indicated in the surface ABCD. FIG. 1*b* shows side DCGH of the wood specimen. Here, the fibres are therefore oriented from side DC to side GH. If a pressure is applied in the middle of the stretch DH, it is not possible to observe any increase in elasticity. FIG. 1*c* show s side ABCD of the abovementioned specimen. By contrast, if a pressure is applied in the middle of stretch AD. it is possible to observe a distinct increase in elasticity. The result of this is shown in FIG. 1*d*. By gluing diffuse-porous wood specimens together in parallel in the manner shown in FIG. 1*e*, a wood material is obtained which possesses a very high degree of flexibility.

As has already been mentioned above, it has also been found that it is possible to decrease the elasticity of the wood material which has been pressed isostatically in accordance with the invention. The wood material recovers its rigidity after it has been immersed in a liquid for a period which is sufficiently long for the liquid to be able to penetrate into the whole of the wood specimen. The time for which the wood material has to be immersed for it to recover its rigidity once again depends on the size of the specimen which is to be shaped. For relatively small specimens having a cross-sectional area of 20×40 mm, an immersion time of 5–15 minutes is entirely adequate, whereas immersion times of up to 2 hours can be required for large specimens. In principle, the immersion can take place at any temperature whatsoever provided the wood material is not damaged and the liquid is still fluid. It is expedient for the immersion step to be carried out at room temperature. By means of simple experiments, the skilled person is readily able to determine suitable immersion times and immersion temperatures in each individual case.

Without tying the invention to any particular theory, it is assumed that, during the immersion, the liquid penetrates into the previously collapsed pores with the aid of osmotic forces and/or a hydrophobic interaction, resulting in the pores being restored to their original volume.

As has already been mentioned, this invention is very useful in connection with shaping wood material, for example in association with manufacturing furniture. Even quite complicated shapes can be obtained. A wood material having an increased degree of elasticity is firstly produced. It required, a suitable workpiece is then sawn out of the said material. The workpiece is then shaped to the desired shape, for example using forms and/or clamps. This desired shape can then be fixed by immersion in a suitable liquid under suitable conditions (such as mentioned above), followed by drying.

There are no restrictions with regard to the size of the wood specimen other than those which relate to the size of the pressing device employed. However, it is particularly advantageous to press disc-shaped wood specimens, and wood specimens having surface areas of more than 2 $m^2$ can be pressed without difficulty as long as the size of the press permits this. Presses of the pressure cell type, which are described in SE-C-452 436, represent an example of a suitable pressing device, and the reader is referred to the above-cited WO 95/13908 with regard to the isostatic pressing of wood.

The wood specimen should have dried before the isostatic pressing takes place. It is advantageous if the moisture content has decreased to at most 50% of the content in the living wood. However, it is also possible to press moist wood isostatically if the liquid which is pressed out can be taken care of, for example by means of absorption, or conducted away from the pressing device. The technique of isostatically pressing moist wood is described in WO 97/02936.

The invention will now be described in more detail with reference to the following implementation examples, which are given for illustration purposes and are not intended to limit the invention.

EXAMPLE 1

A wood specimen in the form of a disc, having a diameter of 19.3 cm and a thickness of 1 cm, was sawn out of an aspen trunk. The disc was debarked and dried to a moisture content which was 48% of the original (see FIGS. 1A and 1B). It was then pressed isostatically in a press of the pressure cell type (ABBE Pressure Systems, Vasteras, Sweden) in the manner described in Example 1 in WO 95/13908. The maximum pressure was 850 bar and the temperature was 33° C. The total pressing time was 2 minutes.

Figure 1A:
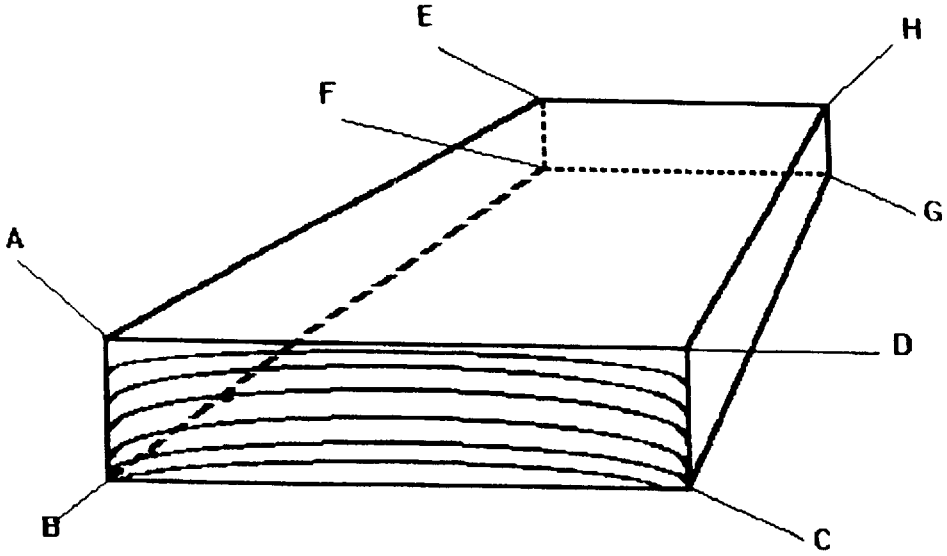
Figure 1B:
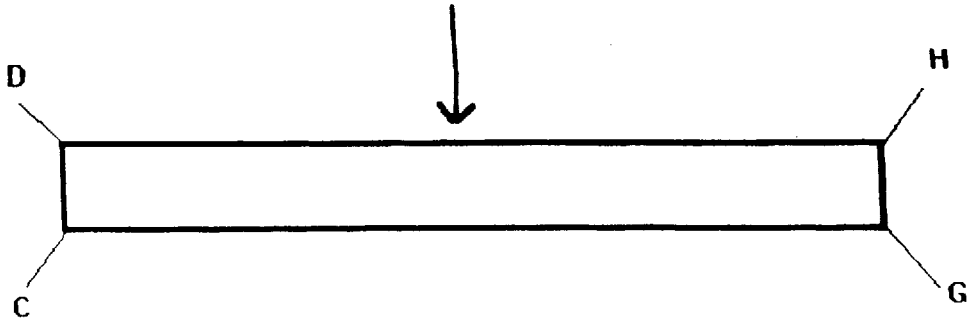
Figure 1C:
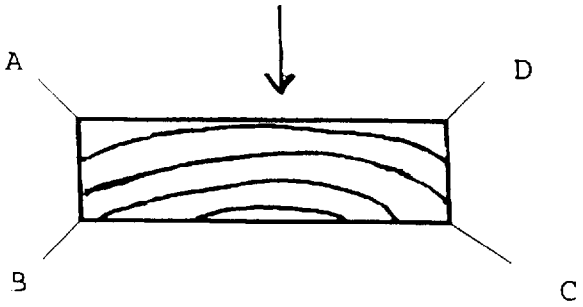
Figure 1D:
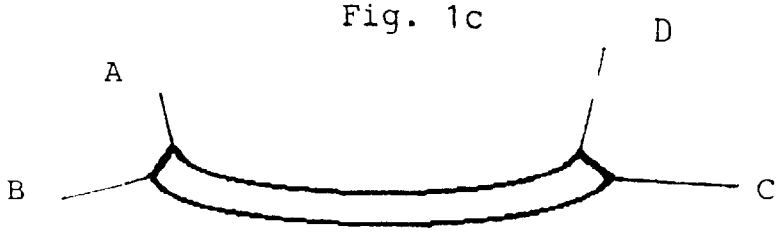
Figure 1E:
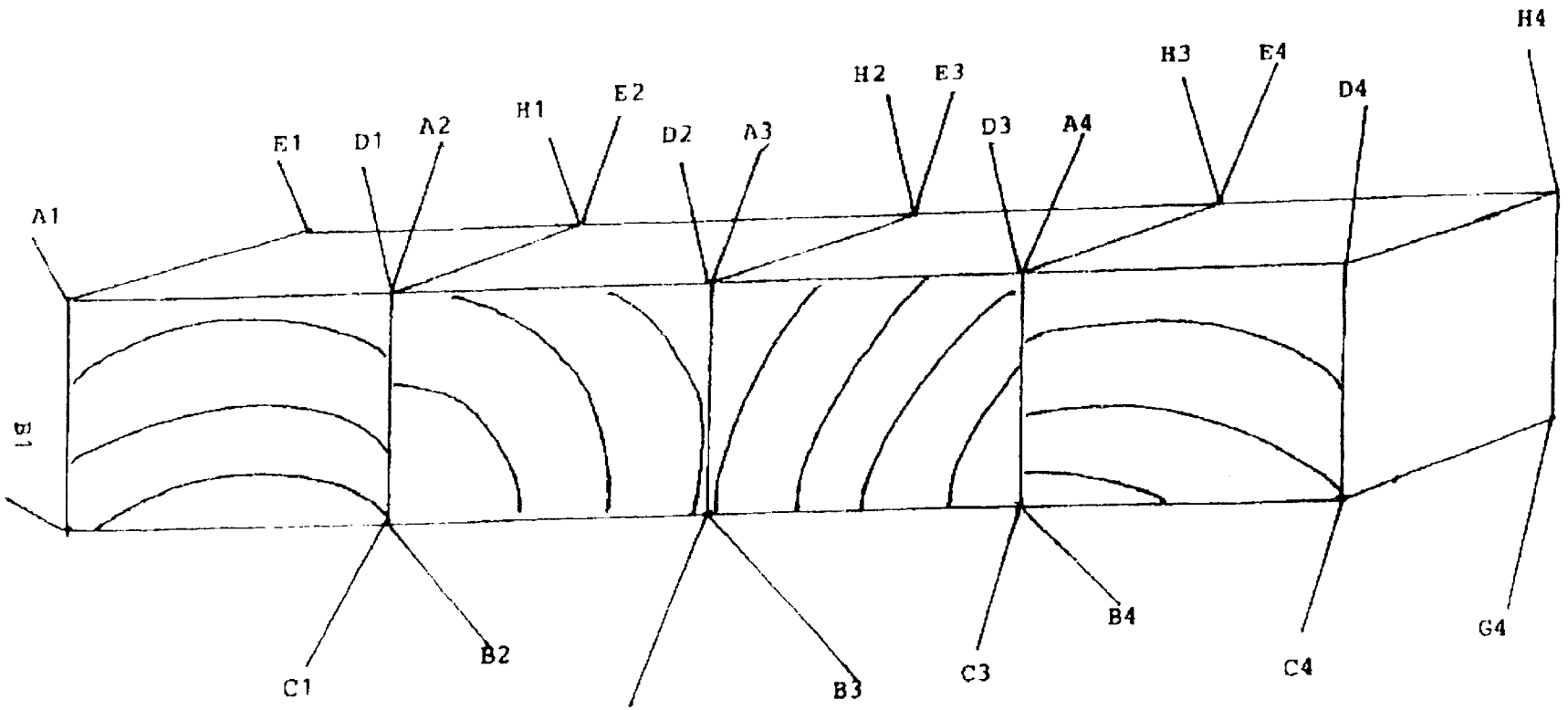
Figure 2A:
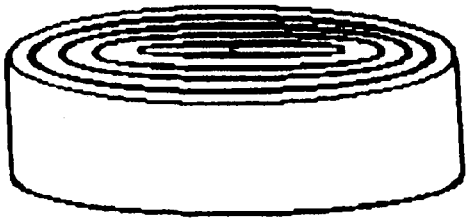
FIG. 2A shows a disc which has been cut directly from a tree trunk.
Figure 2B:
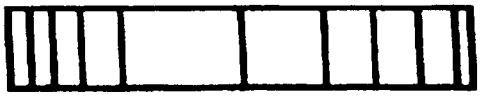
FIG. 2B shows a horizontal cross-section of the disc. The annual rings are indicated.
Figure 2C:
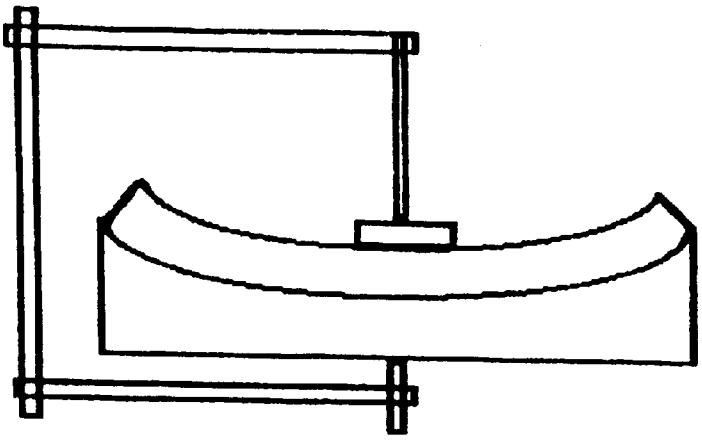
FIG. 2C shows the shaping of the disc (in horizontal cross-section) in connection with immersion in water.
Figure 2D:
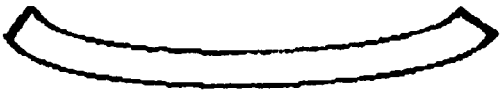
FIG. 2D shows a horizontal cross-section of the bowl which was obtained after drying.

The following steps were carried out at room temperature. The resulting elastic disc was placed in a bowl form having a maximum depth of 4 cm and clamped so that it took the shape of the form (FIG. 2C). The form and the wood disc were immersed in water for 10 minutes and were then allowed to dry. The elasticity of the disc had now decreased markedly and it retained its bow shape even after it had been unclamped from the form (FIG. 2D).

EXAMPLE 2

A specimen of aspen having the dimensions 550×170×35 mm (FIG. 3A, the annual rings are indicated) and a moisture content which was 48% of that of the living tree was used as starting material. The specimen was pressed isostatically in the same manner as in Example 1. The maximum pressure was 1000 bar, the temperature 34° C. and the pressing time 2 minutes. After pressing, the dimensions of the specimen were 438×136×22 mm. It was hand-planed all round to make it completely smooth. The specimen was then sawn through along its length to give three specimens having the dimensions 146×136×22 mm. These specimens were in turn sawn into lamellae of approximately 20 mm in width, and the surfaces were levelled by hand-planing, the lamellae were then placed up against each other such that they lay in the same way as before sawing (FIG. 3B), and furthermore such that the three original specimens lay up against each other. Accordingly, 21 lamellae lay up against each other in the manner which is shown in FIG. 3C. A cold-water glue (Casco 3305, Casco, Sweden) was spread on the upper surface of all the lamellae apart from that furthest out to the right (FIG. 3D). All the lamellae were then turned a quarter revolution in the clockwise direction (FIG. 3E) and subsequently pressed against each other (FIG. 3F) using clamps; the glue was then allowed to dry. This resulted in a composite wood specimen (FIG. 3G) having the dimensions 146×410×22 mm. The specimen was crosscut at 15 mm along its length, resulting in a specimen having the dimensions 15×410×22 mm. his specimen was then bent by hand until it was in the shape of a horseshoe having an internal diameter of 125 mm (FIG. 4). No splits were observed.

EXAMPLE 3

This example relates to determining elasticity modulus of the wooden material of the present invention. Aspen wood, which is diffuse porous, was compressed isostatically with a pressure of 1000 bar. Subsequently, the wood was sawed in pieces of 20×20×200 mm. The direction of the fibres of the pieces was perpendicular to the longitudinal direction of the piece.

A first group (A) of pieces of 20×20×200 mm was provided. The pieces of this group were sawed and glued in the same way as the pieces of group D, but the wood had not been compressed isostatically.

The pieces of the second group (B) were neither sawed nor glued together again.

The pieces of the third group (C) were sawed in 3 pieces of 20 mm×20 mm×60 mm, 20 mm×20 mm×80 mm, and 20 mm×20 mm 60 mm respectively. These pieces were then glued together again using the same glue as in example 2 in such a way that a new combined piece of 20 mm×20 mm×200 mm was obtained and that the direction of the fibres of the piece was perpendicular to the longitudinal direction of the piece.

The pieces of the fourth group (D) were sawed in 5 pieces of 20 mm×20 mm×40 mm. These pieces were then glued together again using the same glue as in example 2 in such a way that a new combined piece of 20 mm×20 mm×200 mm was obtained and that the direction of the fibres of the piece was perpendicular to the longitudinal direction of the piece.

The modulus of elasticity was determined for pieces from all groups. The determinations were carried out in accordance with the European Standard EN 310:1993 (European Committee for Standardization, Brussels, BE). The distance $1_l$ between the two supports 2 and 3 was 150 mm. A deflecting member F deflects the piece to be tested 1 in a point located precisely in the middle between the supporting members 2 and 3.

The results obtained are summarised in table 1.

TABLE 1

| Test group | Modulus of Elasticity |
|---|---|
| A | 615 MPa |
| | 699 MPa |
| B | 347 MPa |
| | 319 MPa |
| C | 172 MPa |
| | 201 MPa |
| D | 25.0 MPa |
| | 64.2 MPa |

It should be noted that the wooden material of the invention (groups C and D) has much lower moduli of elasticity compared to the material of the control groups (groups A and B). It should further be noted that the test piece of group D was so flexible that it did not crack during die defection tests. All test pieces from groups A–C cracked.

What is claimed is:

1. A process producing a composite wood specimen having greatly increased elasticity, which process comprises:

supplying at least two specimens of diffuse-porous wood which have been made elastic by isostatically pressing said specimens with a pressure of at least 500 bars; and gluing said specimens together in such a manner that the fibres are oriented in parallel in a resulting composite wood specimen.

2. The process according to claim 1, wherein the isostatic pressure is at least 850 bars, the pressing temperature is at most 40° C., and the pressing time is at most 5 minutes.

3. A process for producing shaped products made of diffuse-porous wood comprising:

supplying a specimen of diffuse-porous wood or a composite specimen of diffuse-porous wood whose elasticity has been increased using a process according to claim 1 to obtain an elastic wood specimen;

shaping the elastic wood specimen, followed by fixing the specimen using fixing elements to obtain a fixed elastic wood specimen;

immersing the fixed elastic wood specimen in a liquid for a period which is sufficiently long for the liquid to be able to penetrate into the fixed elastic wood specimen;

drying the fixed elastic wood specimen; and releasing the fixed elastic wood specimen from the fixing elements.

4. The process according to claim 3, wherein the elastic wood specimen is immersed in water at room temperature.

5. The process according to claim 4, wherein the elastic wood specimen is immersed in linseed oil/turpentine in a ratio by weight of 1/100–100/1.

6. The process according to claim 4, wherein the elastic wood specimen is immersed during a time period between 5 minutes and 2 hours.

7. A diffuse-porous wood material having increased elasticity, which is produced using a process according to claim 1.

8. A shaped diffuse-porous wood material which is produced using a process according to claim 3.

9. The process according to claim 1, wherein the isostatic pressure is greater then 1000 bare, the pressing temperature is at most 40° C., and the pressing time is at most 5 minutes.

10. The process according to claim 1, wherein the isostatic pressure is at least 850 bars, the pressing temperature is at most 35° C., and the pressing time is at most 5 minutes.

* * * * *